US005590634A

United States Patent [19]

Shinohara

[11] Patent Number: 5,590,634

[45] Date of Patent: Jan. 7, 1997

[54] EVAPORATIVE EMISSION CONTROL SYSTEM FOR AN INTERNAL COMBUSTION ENGINE

[75] Inventor: Susumu Shinohara, Toyota, Japan

[73] Assignee: Toyota Jidosha Kabushiki Kaisha, Aichi, Japan

[21] Appl. No.: 605,485

[22] Filed: Feb. 26, 1996

[30] Foreign Application Priority Data

Feb. 27, 1995 [JP] Japan ..... 7-038467

[51] Int. Cl.[6] ..... F02M 39/04

[52] U.S. Cl. ..... 123/520; 123/198 D

[58] Field of Search ..... 123/520, 519, 123/518, 516, 521, 198 D

[56] References Cited

U.S. PATENT DOCUMENTS

| | | | |
|---|---|---|---|
| 5,275,144 | 1/1994 | Gross | 129/50 |
| 5,363,828 | 11/1994 | Yamashita | 123/520 |
| 5,445,015 | 8/1995 | Namiki | 123/520 |
| 5,448,980 | 9/1995 | Kawamura | 123/520 |
| 5,479,905 | 1/1996 | Ito | 123/520 |
| 5,505,182 | 4/1996 | Denz | 123/520 |

*Primary Examiner*—Carl S. Miller
*Attorney, Agent, or Firm*—Kenyon & Kenyon

[57] ABSTRACT

The evaporative emission control system in the present invention is equipped with a fuel tank and a canister connected to the fuel tank, and a pressure sensor connected to the canister and the fuel tank via a three-way switching valve. The pressure sensor can be selectively connected to the canister and the fuel tank by switching the position of the three-way switching valve. The control circuit, which may consist of a known type of microcomputer, detects failures in the system based on the smoothed pressure values of the canister and the fuel tank. The smoothed pressure value is obtained by smoothing fluctuations of the pressure detected by the pressure sensor. Since the characteristics of the fluctuations of the pressure in the canister and the fluctuations of the pressure in the fuel tank are different, the control circuit changes the degree of smoothing fluctuation when obtaining the smoothed pressure value of the canister and when obtaining the smoothed pressure value of the fuel tank.

4 Claims, 7 Drawing Sheets

EVAPORATIVE EMISSION CONTROL SYSTEM FOR AN INTERNAL COMBUSTION ENGINE

BACKGROUND OF THE INVENTION

1. Field of the Invention

The present invention relates to an evaporative emission control system which prevents emission of fuel vapor in the liquid fuel tank (hereinafter, "liquid fuel" will be referred to as "fuel") to atmosphere. Specifically, the present invention relates to an evaporative emission control system which is capable of detecting failure occurring in the system.

2. Description of the Related Art

An evaporative emission control system which prevents evaporative emission from internal combustion engines is commonly used in automobile engines. Usually, an evaporative emission control system includes a canister containing an adsorbent such as active carbon which adsorbs fuel vapor in a fuel tank of the engine. In such a system, a flow of purge air through the canister is established when the engine is operated at predetermined operating conditions in order to prevent the adsorbent from being saturated with adsorbed fuel vapor. The purge air supplied to the canister causes the adsorbent to release adsorbed fuel vapor, and the purge air after passing through the canister (which contains fuel vapor, and called "purge gas" hereinafter) is supplied to an intake air passage of the engine to burn fuel vapor contained in the purge gas in the combustion chambers of the engine.

If failure occurs within such an evaporative emission control system, fuel vapor in the fuel tank is not supplied to the engine and the fuel vapor is discharged to atmosphere, thus air pollution occurs. For example, when leakage occurs from the canister or fuel tank, or connecting piping between the canister and the fuel tank, or between the canister and the intake air passage of the engine, the fuel vapor is discharged from the leaked portions to atmosphere. Further, even if the leakage occurs in such portions, the driver of the automobile does not notice that the failure has occurred, and may continue the operation of the automobile. Therefore, various failure detecting devices are used to announce the failure in the evaporative emission control system.

An example of such a failure detecting device is disclosed in Japanese Unexamined Patent Publication No. 6-108930. The device in the '930 publication comprises an internal pressure control valve which is disposed in a fuel vapor passage connecting the canister and the fuel tank for controlling the flow rate of the fuel vapor in the fuel vapor passage, and a pressure detecting device which is capable of separately detecting the pressures in the fuel vapor passage at a portion upstream (i.e., the fuel tank side) of the internal pressure control valve and at a portion downstream (i.e., the canister side) of the same. The failure detecting device in the '930 publication determines whether failure occurs in the fuel tank side of the system or in the canister side of the system separately based on the pressures upstream and downstream the internal pressure control valve, detected by the pressure detecting device.

In the '930 publication, the pressure detecting device consists of a single pressure sensor which is, via a three-way switching valve, connected to the portions of the fuel vapor passage upstream and downstream of the internal pressure control valve. Therefore, the pressure sensor can be selectively connected to the upstream portion and the downstream portion of the internal pressure control valve. This enables the device in the '930 publication to detect failure of the system in the upstream side and the downstream side of the internal pressure control valve using a single pressure sensor.

However, a problem arises when the pressures of the fuel vapor passage upstream and downstream of the internal pressure control valve are used separately for detecting failure in the canister and the fuel tank. When detecting a failure of the evaporative emission control system based on the pressure detecting device, the detected pressure value itself cannot be used for failure detection. That is, a smoothed pressure value, which is obtained by smoothing fluctuations of the pressure value detected by the pressure detecting device, must be used for failure detection to eliminate the possibility of error in the detection. During the operation of the engine, the pressure values of the canister and the fuel tank which are detected by the pressure sensor fluctuate, largely due to the vibration of the engine or the movement of fuel in the fuel tank. Further, when failure of the evaporative emission control system is detected based on the pressure in the canister and the fuel tank, the threshold pressures used for the failure detection are relatively small. Therefore, if the raw pressure values (pressure values detected by the pressure sensor) are used for detecting failure in the system, error may occur due to fluctuation of the raw pressure values (i.e., noise in the detected pressure values). To prevent this from occurring, the failure detection of the evaporative emission control system is usually performed based on the smoothed pressure values which are obtained by smoothing fluctuations of the pressure values detected by the pressure sensor.

However, when smoothing fluctuations of the raw pressure values detected by the pressure sensor, further errors may occur if the raw pressure values of the canister and the fuel tank have their fluctuations smoothed to the same degree. The fluctuations of the pressures in the canister and the fuel tank are quite different in their period of cycle and amplitude. Therefore, if both the pressure values of the canister and the fuel tank are smoothed to the same degree, there is a possibility that the pressure change which must be detected for detecting a failure is smoothed, or that fluctuations of the pressures which must be ignored in the failure detection are detected and used for the failure detection.

Therefore, when performing the failure detection of the evaporative emission control system based on the pressures in the canister and the fuel tank, it is necessary to smooth the fluctuations of the detected pressure values of the canister and the fuel tank to an extent in accordance with the respective characteristics of the fluctuations of the pressures in the canister and the fuel tank.

However, in the '930 publication, no consideration is given to this problem. Further, since a single pressure sensor is used for detecting the pressures in both the canister and the fuel tank in the '930 publication, it is naturally considered that the pressure values detected in the canister and the fuel tank both have their fluctuations smoothed to the same degree. Therefore, the '930 publication does not disclose the solution to the above problem.

SUMMARY OF THE INVENTION

In view of the problem set forth above, the object of the present invention is to provide an evaporative emission control system of an internal combustion engine which is capable of detecting failure in the system precisely based on smoothed pressure values of the canister and the fuel tank, by using the smoothed pressure values obtained in accordance with the characteristics of the fluctuations.

The above-mentioned object is achieved by an evaporative emission control system for an internal combustion engine according to the present invention, in which the evaporative emission control system comprises a fuel tank containing fuel for an internal combustion engine, a canister containing an adsorbent for adsorbing fuel vapor, a fuel vapor passage which connects the canister to the fuel vapor volume above the fuel level inside the fuel tank, a purging passage which, when the engine is operated at predetermined conditions, communicates with the canister and an intake air passage of the engine to direct the fuel vapor released from the adsorbent to the intake air passage of the engine, a pressure detecting device which detects the pressure in the canister and the pressure in the fuel tank separately, smoothing means for obtaining smoothed pressure values of the canister and the fuel tank by smoothing the fluctuations of the pressure values of the canister and the fuel tank detected by the pressure detecting device, failure detecting means for detecting failure in the canister and the fuel tank separately based on the smoothed pressure value of the canister and the smoothed pressure value of the fuel tank, respectively, and wherein the smoothing means obtains the smoothed pressure value of the fuel tank by smoothing the fluctuations of the pressure values of the fuel tank at a higher degree of smoothing than the degree of smoothing of the fluctuations of the pressure value of the canister.

During the operation of the engine, usually fluctuations of the pressure value in the canister are mainly caused by vibration of the engine and the amplitude of fluctuation is relatively small. In contrast to this, since fluctuations of the pressure value in the fuel tank is mainly caused by the movement of the fuel in the tank and blockage of the pressure detecting port of the fuel tank by splashing of fuel in the tank, the amplitude of the fluctuations are large compared to the threshold value of the pressure change used for detecting failure in the system. Therefore, the smoothing means in this invention smoothes fluctuations of the pressure values of the canister and the fuel tank to different degrees in accordance with the characteristics of the fluctuations of the respective pressure values. That is, the smoothing means smoothes the fluctuations of the pressure value of the canister to a relatively small degree so that only the fluctuation components having a relatively small amplitude are smoothed to, thereby eliminate mainly small amplitude fluctuations caused by, for example, engine vibration. Therefore, when a relatively large change in the pressure value is caused by failure in the canister, the change in the smoothed pressure value of the canister also becomes large. On the other hand, the smoothing means smoothes the fluctuations of the pressure value of the fuel tank to a relatively large degree so that fluctuation components having a larger amplitude are also smoothed, to thereby eliminate not only small amplitude fluctuations but also large amplitude fluctuations. Therefore, even when a relatively large fluctuation of the pressure value occurs due to movement of fuel in the tank or blockage of the pressure detecting port, the smoothed pressure value does not change largely, thereby errors in determining failure in the system can be prevented.

In another aspect of the present invention, there is provided an evaporative emission control system which comprises a fuel tank containing fuel for an internal combustion engine, a canister containing an adsorbent for adsorbing fuel vapor, a fuel vapor passage which connects the canister to the fuel vapor volume above the fuel level inside the fuel tank, a purging passage which, when the engine is operated at predetermined conditions, communicates the canister and an intake air passage of the engine to direct the fuel vapor released from the adsorbent to the intake air passage of the engine, a pressure detecting device which detects the pressure in the canister and the pressure in the fuel tank separately, smoothing means for obtaining smoothed pressure values of the canister and the fuel tank by smoothing fluctuations of the pressure values of the canister and the fuel tank detected by the pressure detecting device, failure detecting means for detecting failure in the canister and the fuel tank separately based on the smoothed pressure value of the canister and the smoothed pressure value of the fuel tank, respectively, and wherein, the smoothing means obtains the smoothed pressure value of the fuel tank by smoothing fluctuations of the pressure value of the fuel tank in such a manner that the degree of smoothing of the fluctuations of the pressure values are higher as the amount of fuel in the fuel tank is larger.

In this aspect of the invention, the smoothing means changes the degree of smoothing of the fluctuations of the pressure value of the fuel tank in accordance with the amount of fuel contained in the fuel tank. The amplitude of the fluctuations of the pressure value of the fuel tank becomes larger as the fuel level in the fuel tank becomes higher (i.e., the amount of fuel in the fuel tank becomes larger). Therefore, the characteristics of the fluctuations of the pressure value of the fuel tank change according to the amount of fuel in the fuel tank. In this aspect of the invention, when the amount of fuel in the tank is large, i.e., when the amplitude of the fluctuations of the pressure value is large, the smoothing means smoothes the pressure value to a larger degree. Therefore, even if the amplitude of the fluctuations become large due to a high fuel level in the tank, the smoothed pressure value is not affected by the increase in the amplitude of the fluctuations. Thus, failure detection of the evaporative emission control system can be performed without being affected by the amount of fuel in the fuel tank.

BRIEF DESCRIPTION OF THE DRAWINGS

The present invention will be better understood from the description as set forth hereinafter, with reference to the accompanying drawings, in which.

DESCRIPTION OF PREFERRED EMBODIMENTS

Figure 1:
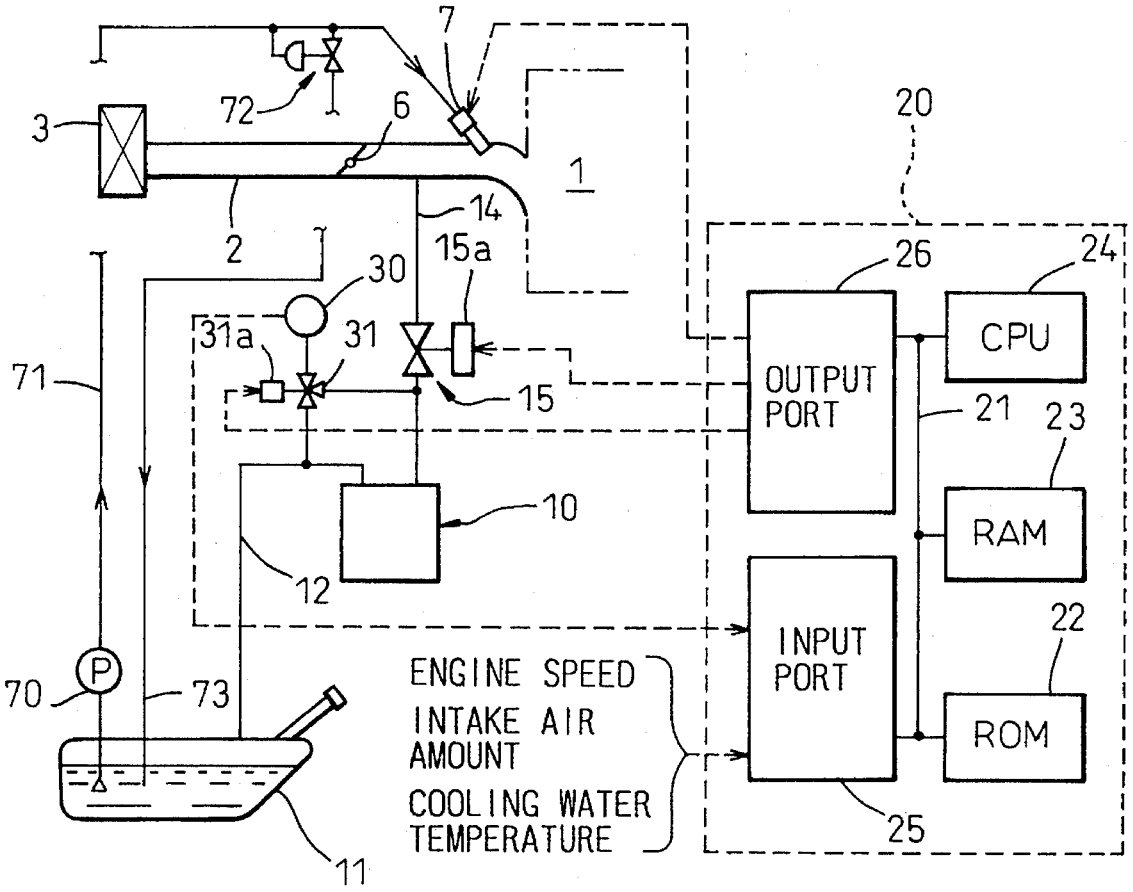
FIG. 1 is a drawing schematically illustrating an embodiment of the evaporative emission control system according to the present invention when applied to an automobile engine.

FIG. 1 schematically illustrates an embodiment of the evaporative emission control system of the present invention when applied to an automobile engine. In FIG. 1, reference numeral 1 designates an internal combustion engine for an automobile, numeral 2 designates an intake air passage of the engine 1, numeral 3 designates an air-cleaner disposed in the intake air passage 2. In the intake air passage 2, a throttle valve 6, which takes a degree of opening determined by the amount of depression of an accelerator pedal (not shown in the drawing) by the driver of the automobile, is disposed. Further, a fuel injection valve 7, which injects pressurized fuel from a fuel supply pump 70 to the intake ports of the respective cylinders of the engine 1, is disposed in the intake air passage 2. Reference numeral 11 in FIG. 1 shows a fuel tank of the engine 1 which stores fuel for the engine 1. Fuel in the fuel tank 11 is pressurized by the fuel pump 70 and is supplied to the fuel injection valve 7 through a feed pipe 71. On the fuel feed pipe 71, a pressure regulator which adjusts the pressure of the fuel supplied to the fuel injection valve 7 to a constant value is provided. The part of the fuel supplied to the fuel injection valve 7 which is not injected to the intake port of the cylinders is returned to the fuel tank 11 through a return pipe 73.

Numeral 20 in FIG. 1 denotes a control circuit of the engine 1. The control circuit 20 may, for example, consist of a microcomputer of conventional type which comprises a ROM 22, a RAM 23, a CPU 24, an input port 25 and an output port 26 connected by a bi-directional bus 21. The control circuit 20 performs basic engine control such as fuel injection control and ignition timing control of the engine 1. Further, in this embodiment, the control circuit 20 performs detection of failure in the evaporative emission control system as explained later in detail. To perform these types of control, parameters representing operating conditions of the engine, such as the engine speed, the flow rate of intake air supplied to the engine, the temperature of the cooling water of the engine are fed to the input port 25 of the control circuit 20 from the corresponding sensors via an A/D (analogue-to-digital) converter (not shown in the drawing). In addition, an output signal from a pressure sensor 30 is also fed to the input port 25 via an A/D converter. The pressure sensor 30 will be explained later.

Numeral 10 in FIG. 1 denotes a canister for adsorbing fuel vapor evaporated from the fuel in the fuel tank 11. The canister 10 is connected to the fuel tank 11 by a fuel vapor passage 12 at the portion above the fuel level therein. The canister 10 is also connected to the intake air passage 2 at the portion downstream of the throttle valve 6 by a purge gas passage 14. Numeral 15 in FIG. 1 shows a purge control valve. The purge control valve 15 is equipped with an actuator 15*a* of appropriate type, such as a solenoid actuator or vacuum actuator. The actuator 15*a* actuates in response to a drive signal supplied from the control circuit 20 and opens the purge control valve 15 under a predetermined operating condition of the engine 1 to connect the canister 10 and the portion of the intake air passage 2 downstream of the throttle valve 6, thereby generating a purge gas flow through the canister 10.

Figure 2:
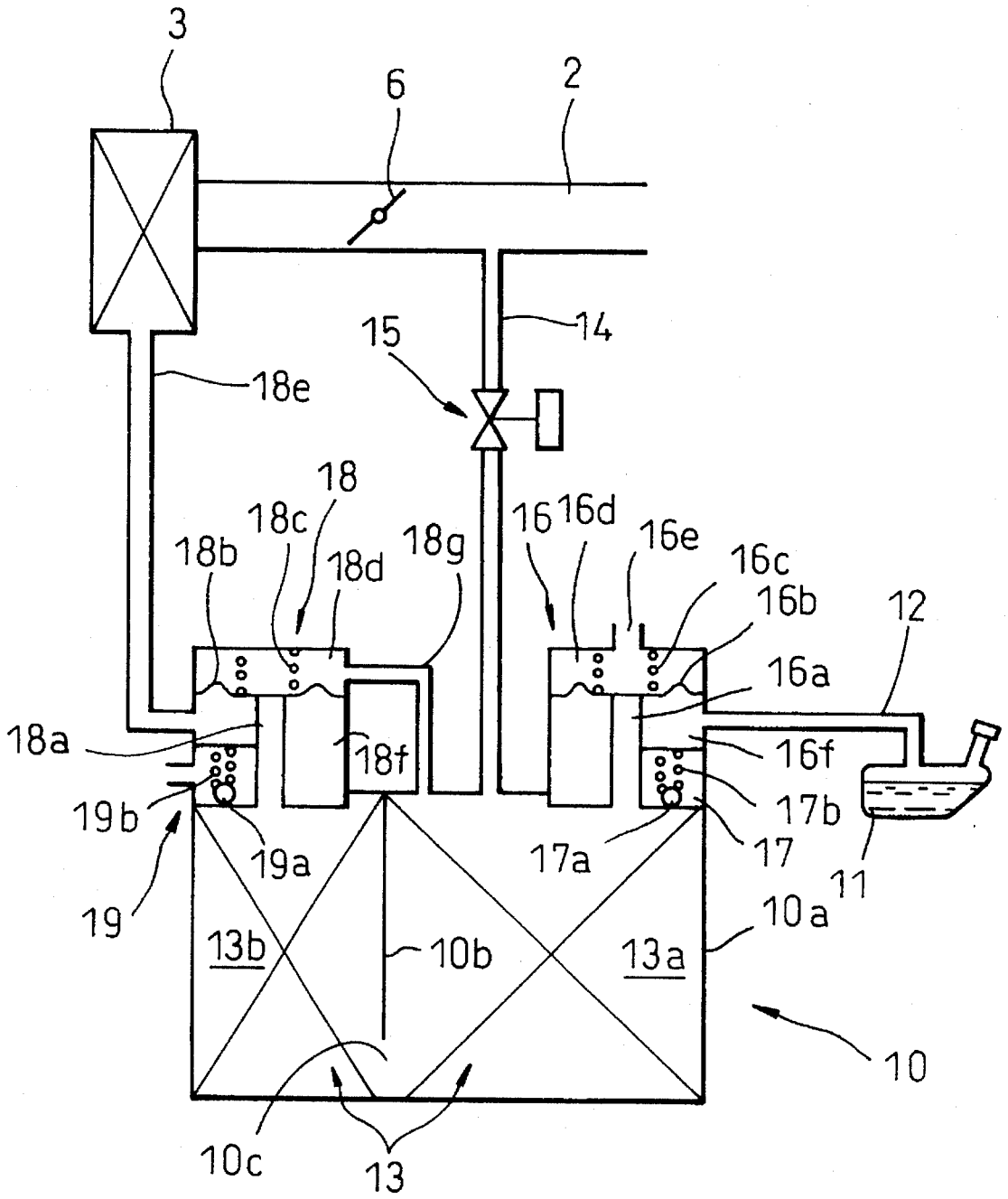
FIG. 2 is a drawing schematically illustrating a typical construction of the canister used in the evaporative emission control system.

FIG. 2 illustrates the construction of the canister 10 in FIG. 1. Typically, the canister 10 comprises a housing 10*a* and a fuel vapor adsorbent 13, such as active carbon, filled in the housing 10*a*. On the housing 10*a*, an internal pressure control valve 16 and an atmospheric valve 18 are provided to control the operation for adsorption of fuel vapor to the adsorbent 13 and releasing of the adsorbed fuel vapor from the adsorbent (i.e., purging of fuel vapor from the adsorbent 13). The operation for adsorption and purging of fuel vapor will be explained later.

In the housing 10*a*, a separator plate 10*b* is disposed at the position between the internal pressure control valve 16 and the atmospheric valve 18. The adsorbent 13 in the housing 10*a* is divided by the separator plate 10*b* into two sections, i.e., the section 13*a* on the internal pressure control valve 16 side and the section 13*b* on the atmospheric valve 18 side. On the separator plate 10*b*, an aperture 10*c* which communicates the section 13*a* and the section 13*b* is provided on the opposite end thereof from the valves 16 and 18.

The internal pressure control valve 16 comprises a port 16*a* communicating inside of the housing 10*a* and a diaphragm 16*b*. The diaphragm 16*b* is urged by the spring 16*c* to the port 16*a* so that the port 16*a* is closed by the diaphragm 16*b*. A pressure chamber 16*d* is formed on the spring 16*c* side of the diaphragm and communicates to the atmosphere. Further, another pressure chamber 16*f* which communicates to the fuel tank 11*a* via the fuel vapor passage 12 is formed on the side of the diaphragm 16*b* opposite to the pressure chamber 16*d*. The pressure chamber 16*f* communicates with the inside of the housing 10*a* via a pressure equalizing valve 17 having a check ball 17*a* and spring 17*b*.

The atmospheric valve 18 has a similar construction to that of the internal pressure control valve 16 and comprises a port 18*a* communicating to the inside of the housing 10*a*, a diaphragm 18*b* and a spring 18*c*. However, in the atmospheric valve 18, a pressure chamber 18*d* formed on the spring 18*c* side of the diaphragm 18*b* is connected to the section 13*a*, which is formed on the internal pressure control valve 16 side in the housing 10*a*, through a pipe 18*g*. Further, a pressure chamber 18*f* formed on the side of the diaphragm 18*b* opposite to the pressure chamber 18*d* is connected to the air-cleaner 3 via a pipe 18*e*. The section 13*b* of the adsorbent 13 inside the housing 10*a* is connected to the atmosphere via a relief valve 19 comprising a check ball 19*a* and a spring 19*b*. The purge gas passage 14 stated before is connected to the section 13*a* of the adsorbent 13 which is located on the internal pressure control valve 16 side in the housing 10*a*.

Next, an operation of adsorbing and purging of fuel vapor by the canister 10 is explained with reference to FIG. 2. In FIG. 2, when the fuel temperature rises with the internal purge control valve 15 being closed, the pressure in the fuel tank 11 increases due to evaporation of fuel inside the fuel tank 11. Since fuel vapor volume above the fuel level in the fuel tank 11 communicates to the pressure chamber 16*f* in the internal pressure control valve 16, the pressure in the pressure chamber 16*f* also increases due to a pressure rise in the fuel tank 11. Further, atmospheric pressure is introduced to the pressure chamber 16*d* which is on the side of the diaphragm 16*b* opposite to the pressure chamber 16*f*, through the port 16*e*. Therefore, when the pressure in the fuel tank 11 becomes higher than the atmospheric pressure by a predetermined amount, the pressure inside the pressure chamber 16*f* moves the diaphragm 16*b* against the urging force of the spring 16*c*. This causes the port 16*a* to open, thereby fuel vapor in the tank 11 flows into the housing 10*a*. By this, the pressure inside the housing 10*a* also increases, and the increased pressure in the housing pushes the check ball 19*a* of the atmospheric valve 19 against the urging force of the spring 19*b*. This causes the section 13*b* in the housing 10*a* to communicate with the atmosphere through the atmospheric valve 19. When the section 13*b* communicates with the atmosphere, a mixture of fuel vapor and air in the fuel tank 11 flows into the canister 10 through the port 16*a*, and flows through the sections 13*a* and 13*b* of the absorbent 13 to the atmospheric valve 19. When the mixture flows through the adsorbent 13, fuel vapor is adsorbed by the adsorbent 13, and only air is released from the atmospheric valve 19 to the atmosphere. The force of the spring is set in such a manner that the atmospheric valve 19 opens when the pressure inside the canister 10 becomes only slightly higher than the atmospheric pressure. Therefore, when the pressure in the fuel tank 11 reaches the pressure at which the internal pressure control valve 16 opens (for example, about 1 KPa (100 $mmH_2O$) above the atmospheric pressure), the fuel tank 11 communicates with the atmosphere through the canister 10, and the pressure in the fuel tank 11 is kept lower than or equal to the above mentioned predetermined pressure.

Further, when the engine 1 is operated at a predetermined operating condition, the purge control valve 15 is opened. This causes the section 13*a* in the housing 10*a* to communicate with the intake air passage 2 at the portion downstream of the throttle valve 6 through the purge gas passage 14. When this occurs, a negative pressure in the intake air passage 2 downstream of the throttle valve 6 is introduced to the housing 10*a* and lowers the pressure inside the housing 10*a*. Since the pressure chamber 18*d* in the atmospheric valve 18 is connected to the section 13*a* inside the housing through the pipe 18*g*, the pressure in the pressure chamber 18*d* becomes lower than the atmospheric pressure. Thereby, the diaphragm 18*b* is pushed by the pressure in the pressure chamber 18*f* which is connected to the air-cleaner 3 by the pipe 18*e* to open the port 18*a* against the urging force of the spring 18*c*. Thus, clean air from the air-cleaner 3 flows into the section 13*b* in the housing 10*a* through the pipe 19*e* and the port 18*a*. This clean air flows through the sections 13*b* and 13*a* of the adsorbent 13, then, flows into the intake air passage 2 via the purge gas passage 14. When the air flows through the adsorbent 13, the fuel vapor adsorbed by the adsorbent 13 is released (purged) from the adsorbent, thereby the adsorbent 13 is prevented from being saturated with fuel vapor. Fuel vapor released from the adsorbent 13 mixes with the purge air from the air-cleaner 3, and forms a mixture of air and fuel vapor (i.e., purge gas). Since this purge gas is fed to the engine 1 and burned in the combustion chamber thereof, emission of the evaporated fuel from the fuel tank 11 is prevented. The spring 18*c* of the atmospheric valve 18 is set in such a manner that the atmospheric valve 18 opens when the pressure inside the canister 10 becomes lower than the atmospheric pressure by, for example, about 1.5 KPa (150 $mmH_2O$) to introduce clean air from the air-cleaner 3 into the canister 10.

Further, when the engine is stopped, the temperature of the fuel in the fuel tank becomes low, thereby the pressure in the fuel tank 11 decreases. When the pressure in the fuel tank 11 becomes lower than the pressure in the canister 10, the equalizing valve 17 is opened by the pressure in the canister 10, and the canister 10 is connected to the fuel tank 11 by the fuel vapor passage 12. Therefore, when the pressure in the fuel tank 11 becomes lower than the atmospheric pressure, the pressure in the canister housing 10*a* also becomes lower than the atmospheric pressure, thereby the atmospheric valve 18 opens. This causes the clean air from the air-cleaner 3 to be introduced into the canister housing 10*a*, and flows into the fuel tank 11 through the adsorbent 13, equalizing valve 17 and the fuel vapor passage 12. Therefore, the pressure in the fuel tank 11 does not become excessively low even when the temperature of the fuel in the tank 11 becomes low. The spring 17*b* in this embodiment is set in such a manner that the equalizing valve 17 opens when the pressure in the fuel tank 11 becomes lower than the pressure in the canister housing 10*a* by, for example, about 0.5 KPa (50 $mmH_2O$).

As explained above, if the elements in the evaporative emission control system such as the canister 10, the pipes 12, 14 and the purge control valve 15 work properly, the adsorbent 13 in the canister 10 adsorbs and releases fuel vapor in accordance with the opening and closing of the purge control valve 15 to prevent emission of fuel vapor to the atmosphere. However, if any of the elements fails, emission of fuel vapor may occur. Typically, if leakage from the fuel tank 11 or canister housing 10*a* occurs, fuel vapor is released to the atmosphere.

In this embodiment, a pressure sensor 30 (FIG. 1) is provided in order to detect such a failure. The pressure sensor 30 generates a voltage signal corresponding to the difference between the pressure to be detected and the atmospheric pressure, and this analogue voltage signal is fed to the input port 25 of the control circuit 20 after it is converted to a digital signal by an A/D converter (not shown). The pressure sensor 30 is connected to the fuel vapor passage 12 and the portion of the purge gas passage 14 between the canister 10 and the purge control valve 15 via a three-way switching valve 31 so that it can detect the pressure in the fuel vapor passage 12 (i.e., the pressure in the fuel tank 11) and the pressure in the purge gas passage 14 (i.e., the pressure in the canister housing 10*a*) selectively by switching the three-way switching valve 31. Numeral 31*a* in FIG. 1 shows an actuator of an appropriate type, such as a solenoid actuator or a vacuum actuator. The actuator 31*a* is connected to the output port 26 of the control circuit 20 via a driving circuit (not shown) and switches the three-way switching valve 31 in response to a driving signal from the control circuit 20.

In this embodiment, failure in the evaporative emission control system is detected by the method explained hereinafter.

In the following description, detection of two typical types of failure, i.e., (1) leakage from the fuel tank 11 and (2) leakage from the canister housing 10*a* are explained. However the present invention can be applied to the case in which other types of failure such as a malfunction of the purge control valve 15 are detected.

(1) Detection of leakage from the fuel tank 11.

In this embodiment, leakage from the fuel tank 11 is detected by monitoring the change in the pressure in the fuel tank 11 after the engine has started.

When the engine is cold started, the pressure in the fuel tank is low because of the low fuel temperature in the fuel tank. When the temperature of the fuel in the fuel tank 11 is low, the pressure in the fuel tank may become lower than atmospheric pressure, however, since the pressure in the fuel tank is controlled by the atmospheric valve 18 and equalizing valve 11 as explained before, the pressure in the fuel tank does not become lower than a pressure determined by the settings of these valves even when the temperature of fuel is low. Namely, the pressure in the fuel tank is always maintained at higher than a negative pressure determined by the sum of the pressure settings of the atmospheric valve 18 (for example, 1.5 KPa) and the equalizing valve 17 (for example, 0.5 KPa). (In this case the pressure in the fuel tank is kept higher than (−1.5 KPa)+(−0.5 KPa)=(−2.0 KPa).)

On the other hand, if the engine is started in a hot condition, the pressure in the fuel tank at the engine start is higher than the atmospheric pressure due to the high temperature of fuel in the tank 11. However, also in this case, the pressure in the tank 11 is kept lower than the pressure setting of the internal pressure control valve 16 (for example, 1 KPa) since if the pressure in the tank 11 exceeds this pressure, the internal pressure control valve 16 opens to relieve the pressure in the tank 11 to the canister 10.

Once the engine has started, the level of fuel in the fuel tank 11 goes down since the fuel is pumped from the fuel tank by the fuel pump 70. Therefore, the pressure in the fuel tank 11 decreases due to a decrease in the fuel level in the tank, and when a certain time has elapsed after the engine starts, the pressure in the fuel tank 11 becomes lower than the pressure when the engine started.

Further, after the pressure in the fuel tank 11 becomes lowest, it starts to increase again gradually since the fuel temperature in the fuel tank gradually increases due to hot fuel returning to the tank 11 from the return pipe 73.

Figure 3:
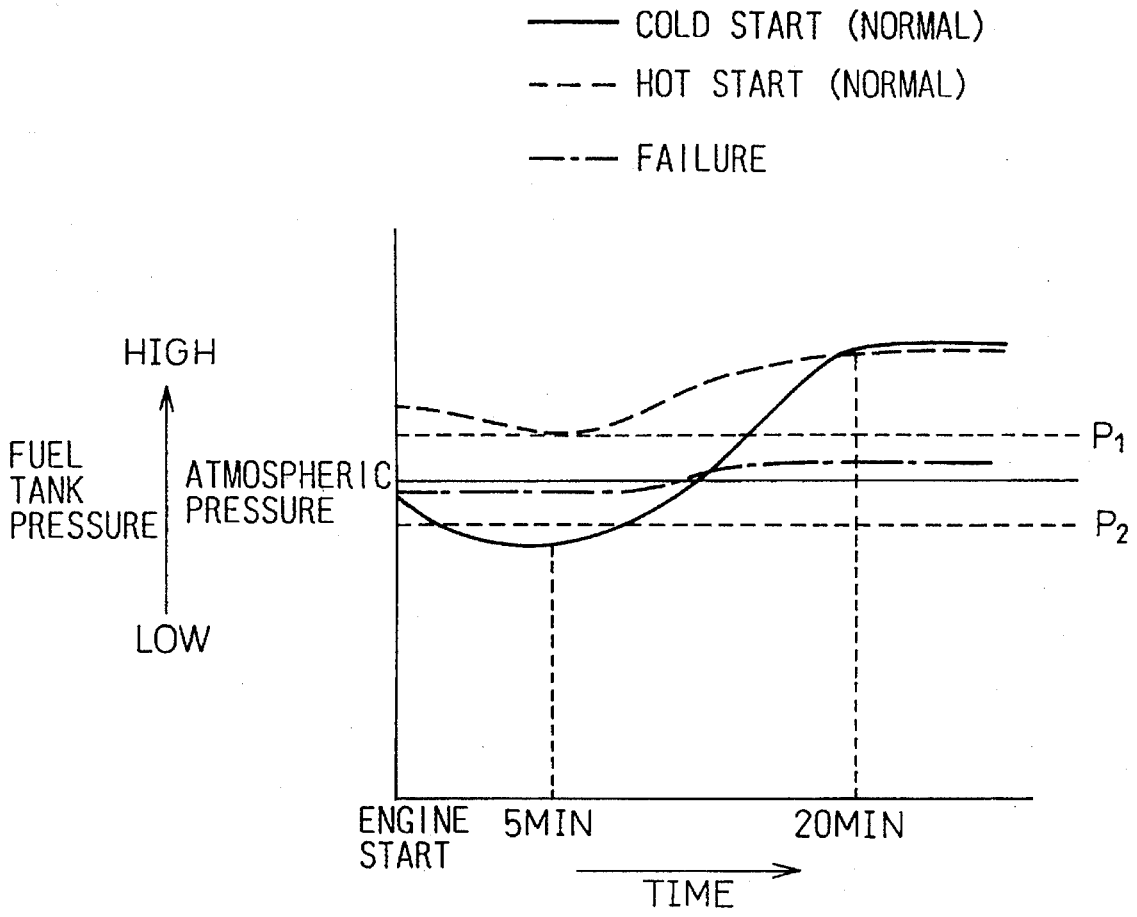
FIG. 3 is a graph showing a typical change in the smoothed pressure value of the fuel tank after the engine is started.

FIG. 3 illustrates the change in the pressure in the fuel tank 11 after the engine starts. In FIG. 3, the solid line indicates the change in the pressure in the fuel tank 11 having no leakage after the engine 1 is started in a cold condition and the broken line indicates the change in the pressure in the fuel tank 11 having no leakage when the engine 1 is started in a hot condition. As seen from the solid line in FIG. 3, when the engine is started in a cold condition and if there is no leakage from the tank 11, the pressure in the tank 11 goes down temporarily after the engine started and becomes lower than the atmospheric pressure due to a decrease in the fuel level, and the pressure in the tank 11 usually becomes lowest about 5 minutes after the engine has started. In this case, the pressure in the tank 11 gradually increases after it reaches the lowest pressure, and usually at about 20 minutes after the engine starts, the pressure reaches near the setting pressure of the internal pressure control valve 16. On the other hand, as indicated by the broken line in FIG. 3, when the engine is started in a hot condition as is the case in which the engine is re-started after a short stop period, and if there is no leakage from the tank 11, the pressure in the fuel tank 11 is higher than the atmospheric pressure since the temperature of fuel in the tank 11 is usually high. Therefore, as indicated by the broken line in FIG. 3, the pressure in the fuel tank 11 reaches the setting pressure of the internal pressure control valve 16 in a short time after the engine starts.

In contrast to this, the chain line in FIG. 3 indicates the change in the pressure in the fuel tank 11 after the engine starts in the case that the fuel tank 11 leaks. If the fuel tank leaks, since the inside of the tank 11 directly communicates to the atmosphere, the pressure in the fuel tank is maintained at a pressure near the atmospheric pressure regardless of the fuel temperature and fuel level in the tank. Therefore, if the pressure in the fuel tank stays near the atmospheric pressure, i.e., if the pressure in the fuel tank does not change more than a certain amount after the engine starts, it is considered that the fuel tank 11 leaks.

In this embodiment, the control circuit 20 switches the three-way switching valve 31 after the engine is started, to the position in which the pressure sensor 30 is connected to fuel vapor passage 12. Since the pressure in the fuel vapor passage 12 is the same as the pressure in the fuel tank 11, the pressure in the fuel tank 11 can be detected by the pressure sensor 30 by switching the three-way switching valve 31 to this position. Then, the control circuit 20 monitors the pressure in the fuel tank 11 until a predetermined time (for example, 5 to 20 minutes) has elapsed after the engine starts, and the control circuit 20 determines whether the pressure P in the fuel tank becomes higher than a first predetermined value $P_1$ or the pressure P becomes lower than a second predetermined value $P_2$. The first predetermined value $P_1$ and the second predetermined value $P_2$ are determined in accordance with the magnitude of leakage to be detected and, in this embodiment, the first predetermined value $P_1$ is set at a positive pressure around 0.3 KPa (30 $mmH_2O$), and the second predetermined value $P_2$ is set at a negative pressure around −0.3 KPa (−30 $mmH_2O$), as shown in FIG. 3. If the pressure P in the fuel tank does not become higher than $P_1$ nor lower than $P_2$ during the monitoring period, the control circuit 20 determines that a leak has occurred in the fuel tank 11, i.e., the evaporative emission control system has failed.

As explained before, if there is no leakage in the fuel tank, the pressure P in the fuel tank 11 first decreases to a pressure lower than atmospheric pressure after the engine has started, then increases again to a pressure near the setting of the internal pressure control valve 16 in the case of a cold engine start, or increases to a pressure near the setting pressure of the internal pressure control valve 16 in a short time after the engine has started in the case of a hot engine start. Therefore, when the pressure P in the fuel tank does not become higher than $P_1$ (positive pressure) nor lower than $P_2$ (negative pressure), it is considered that a leakage has occurred in the fuel tank 11. By the above method, a leakage from the fuel vapor passage 12, as well as a leakage from the fuel tank 11 can be detected.

(2) Detection of leakage from the canister 10.

In this embodiment, leakage from the canister 10 is detected using the change in the pressure in the canister 10 when the purge control valve 15 is opened and closed.

When the purge control valve is opened during the operation of the engine, since a negative pressure in the intake air passage 2 downstream of the throttle valve 6 is introduced into the canister housing **10*a* via the purge gas passage 14, the pressure in the canister housing 10*a* becomes lower than the atmospheric pressure. In this case, if the purge control valve 15 is closed again (i.e., if a purge cut operation is performed), the pressure in the canister 10 is maintained at a negative pressure near the setting pressure of the atmospheric valve 18. (When the purge cut operation is performed within a certain time after the engine has started, since the pressure in the fuel tank 11 goes down due to a decrease in the fuel level, the equalizing valve 16 is kept closed, and no pressure rise in the canister 10 due to fuel vapor from the fuel tank 11 occurs.) However, if there is a leakage in the canister housing 10*a*, since ambient air flows into the canister 10 through the leaked portion, the pressure in the canister 10 increases after the purge control valve 15 is closed. Therefore, the leakage of the canister 10 can be detected by monitoring the pressure in the canister 10** during the purge cut operation.

Figure 4:
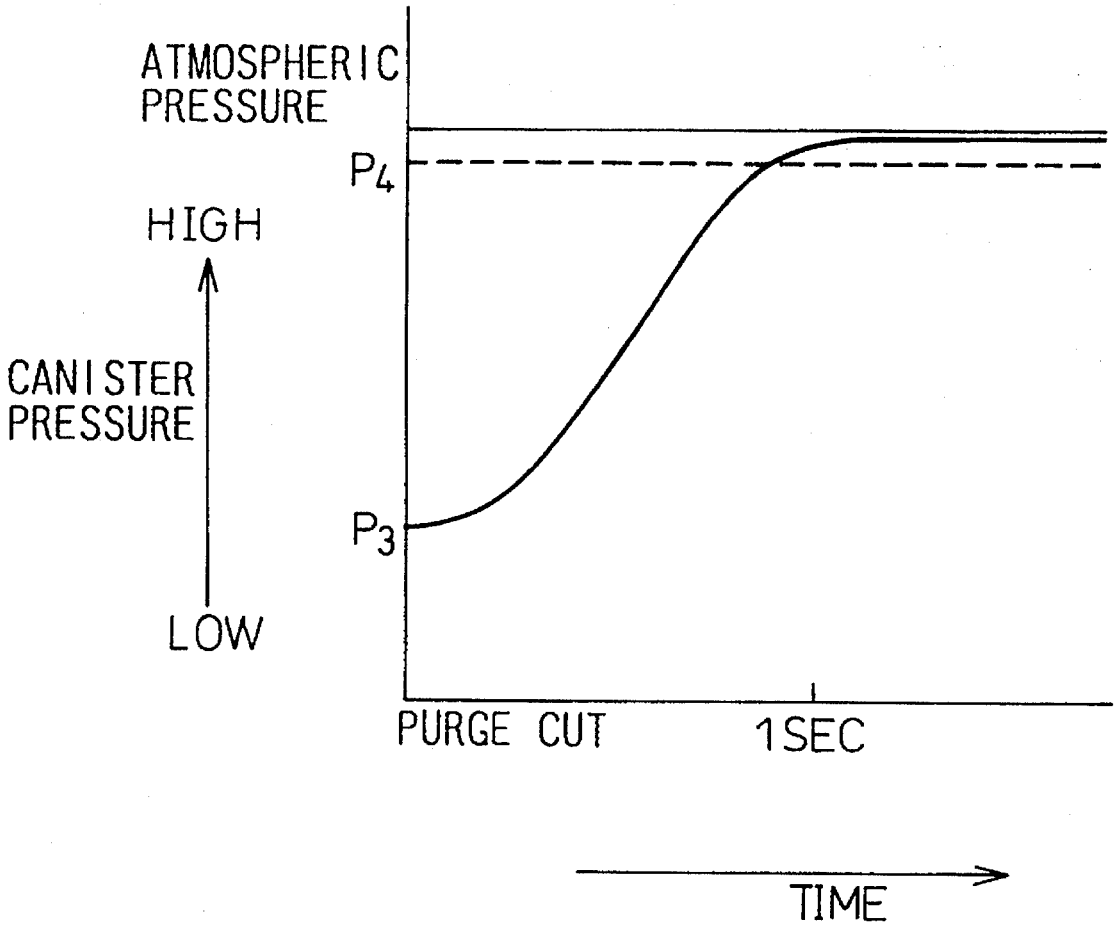
FIG. 4 is a graph showing a typical change in the smoothed pressure value of the canister after a purge operation of the canister is stopped.

FIG. 4 schematically illustrates the change in the pressure in the canister 10 after the purge control valve 15 is closed. In FIG. 4, the solid line represents the change in the pressure in the canister when there is no leakage in the canister 10, and the broken line represents the same when the canister 10 leaks. Since the volume in the canister housing **10*a* is relatively small, if the canister 10 leaks, the pressure in the canister increases rapidly after the purge control valve 15 is closed, as shown by the solid line in FIG. 4**.

In this embodiment, when a purging operation is first performed after the engine has started, the control circuit 20 closes the purge control valve 15 during the purging operation, and monitors the pressure in the canister 10 until a predetermined time has elapsed after closing the purge control valve 15. If the pressure in the canister 10 increases more than a predetermined value during the monitoring period, the control circuit 20 determines that the canister 10 is leaking. Namely, the control circuit 20 opens the purge control valve 15 by actuating the actuator 15*a* of the purge control valve 15 when predetermined conditions are satisfied after the engine 1 has started. The predetermined conditions mentioned above are, for example, the cooling water temperature of the engine 1 is higher than a predetermined value (i.e., the engine warming up is completed), the air-fuel ratio of the engine is feedback controlled (i.e., the operating air-fuel ratio of the engine 1 is not affected by the introduction of the purge gas from the canister), the flow rate of the intake air is more than a predetermined value, and a fuel cut operation is not being performed. When all of these conditions are satisfied after the engine has started, the control circuit 20 performs the purging operation by opening the purge control valve 15.

During the first purging operation performed after the start of the engine, the control circuit 20 switches the three-way switching valve 31 to the position in which the pressure sensor 30 is connected to the purge gas passage 14. Since the pressure in the purge gas passage 14 is the same as the pressure in the canister 10, the pressure in the canister 10 is detected by the pressure sensor 30 when the three-way switching valve is switched to this position. Then, the control circuit 20 temporarily closes the purge control valve 15, and detects the pressure $P_3$ in the canister 10 when the purge control valve 15 is closed and the pressure $P_4$ in the canister 10 when a predetermined time T has elapsed after the valve 15 is closed. Then, if the amount of the pressure rise ($P_4$–$P_3$) is larger than a predetermined value $\Delta P_0$, the control circuit 20 determines that the canister 10 is leaking. The predetermined time T and the value $\Delta P_0$ are determined in accordance with the magnitude of leakage to be detected, and in this embodiment, T is set at around 1 second and $\Delta P_0$, is set at around 0.3 KPa (30 $mmH_2O$). By this method, leakage from the purge gas passage 14, as well as leakage from the canister 10 can be detected.

As explained above, the failure of the canister 10 and the fuel tank 11 is detected in accordance with the change in the pressure during a predetermined time period, and the threshold value for the failure detection is relatively small in both cases. On the other hand, the pressure value detected by the pressure sensor 30 fluctuates due to the engine vibration and the movement of fuel in the fuel tank. Therefore, if the failure detection is performed based on the raw pressure values detected by the pressure sensor 30, error in the detection occurs.

To eliminate this error from the detection of failures, smoothed pressure values, instead of the raw pressure values detected by the pressure sensor 30, are used for detecting failures in the system in this embodiment. The smoothed pressure values are obtained by smoothing fluctuations of the raw pressure values by the method explained below.

Figure 5:
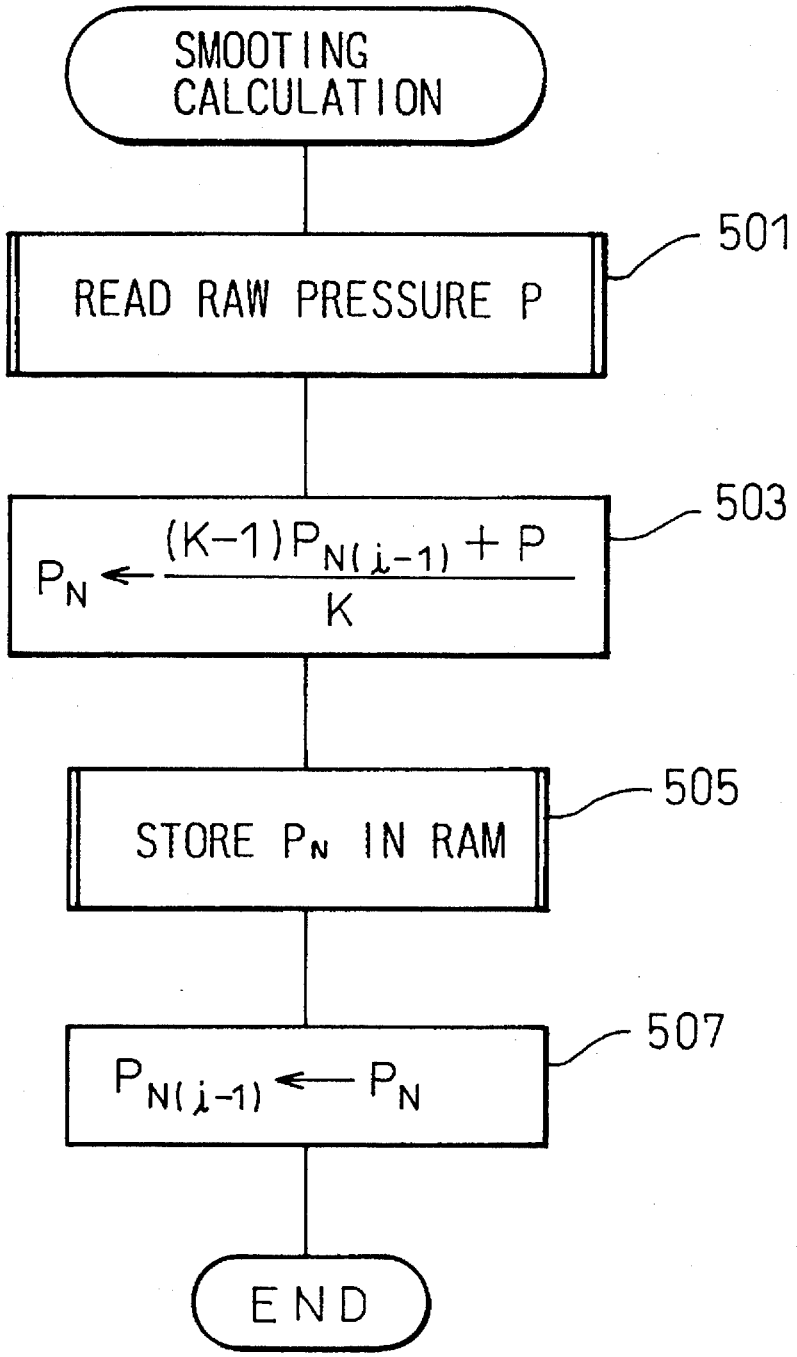
FIG. 5 is a flowchart illustrating an example of a smoothing processing of the pressure values.

FIG. 5 is a flowchart showing a smoothing processing used for obtaining the smoothed pressure values in this embodiment. This routine is processed by the control circuit 20 at predetermined intervals (for example, every 0.1 sec).

When the routine starts in FIG. 5, the raw pressure value P detected by the pressure sensor is A/D converted at step 501. Then, at step 503, the smoothed pressure value $P_N$ is calculated by the following formula.

$$P_N=\{(K-1)\times P_{N(i-1)}+P\}/K$$

In the above formula, $P_{N(i-1)}$ is the smoothed pressure value calculated when the routine is last executed, and K is a weighting factor which represents degree of smoothing. The smoothed pressure value $P_N$ calculated at step 503 is stored in the RAM 23 in the control circuit 20 at step 505. Then, the value of $P_{N(i-1)}$ is renewed at step 507 to prepare next execution of the routine before the routine terminates this time.

Namely, the smoothed pressure value $P_N$ is calculated as a weighted mean of the smoothed pressure value $P_{N(i-1)}$ when the routine is last executed and the raw pressure value P detected by the pressure sensor 30 using a weighting factor K. By the smoothing processing as explained above, since fluctuations of the raw pressure value P are smoothed, the smoothed pressure value $P_N$ obtained by this processing becomes stable. Therefore, by determining failure based on the smoothed pressure value $P_N$, errors caused by fluctuations of the raw pressure can be eliminated.

Further, as understood from the above formula, the degree of smoothing of the fluctuations can be adjusted by changing the value of the weighting factor K. For example, if the weighting factor K is set at a larger value, the degree of smoothing of the fluctuations becomes larger, i.e., the smoothed pressure value $P_N$ becomes less affected by fluctuations of the raw pressure values and the response of $P_N$ to changes in the raw pressure value becomes slow.

However, when detecting failure based on the smoothed pressure values of the canister 10 and the fuel tank 11, problems may arise if the same weighting factor is used to obtain the smoothed pressure values in both cases. As explained before, though the raw pressure values of the canister 10 and the fuel tank 11 both fluctuate, the characteristics of the fluctuations are quite different from each other. For example, the fluctuations of the pressure in the canister 10 is mainly caused by the engine vibration and the period of the fluctuations are relatively short and the amplitude thereof is relatively small. Further, in order to detect the failure in the canister 10, the pressure change in a relatively short period (for example, about 1 second) must be detected. Therefore, if the weighting factor K used in the smoothing calculation is set at a large value, the change in the smoothed pressure value $P_N$ of the canister 10 becomes excessively slow. In this case, the change in the smoothed pressure value $P_N$ does not follow the pressure change in the canister 10 and the change in the smoothed pressure value does not reach the above-noted predetermined value during the monitoring period even when the actual pressure in the canister changes more than the predetermined value. Namely, when detecting failures in the canister 10, if the weighting factor K is set at a large value, errors may occur in which a failed canister is determined to be normal.

On the other hand, the fluctuations of the pressure in the fuel tank 11 are mainly caused by the movement of fuel in the fuel tank and blockage of the fuel vapor passage 12 by a rollover valve as explained later, and the period and the amplitude of the fluctuations are relatively large. Further, in order to detect failures of the fuel tank, the pressure in the fuel tank must be monitored for a time period much longer than that required for detecting failures of the canister (for example, 5 to 20 minutes). In this case, if the weighting factor K is set at a small value, the calculated smoothed pressure value $P_N$ becomes too sensitive to fluctuations of the pressure in the fuel tank. This causes $P_N$ to follow the fluctuations of the raw pressure in the fuel tank, i.e., the smoothed pressure value $P_N$ itself fluctuates. Therefore, in some cases, the value of $P_N$ exceeds the above-noted predetermined values $P_1$ or $P_2$ due to its fluctuations even if the actual pressure stays near the atmospheric pressure. Namely, in contrast to the failure detection of the canister, an error may occur in which a failed fuel tank is determined to be normal when the weighting factor K is set at a small value. This means that if the same weighting factor K is used for the calculations of the smoothed pressure values of fuel tank and canister, errors in detection may occur. Therefore, the weighting factor K in the calculation of the smoothed pressure value $P_N$ in the fuel tank must be set at a value larger than that in the calculation of the smoothed value $P_N$ in the canister, in order to detect failures correctly in both cases.

In this embodiment, in order to prevent the errors explained above, the weighting factor K is set at different values in the calculations of the smoothing pressure values of the canister and the smoothing pressure values of the fuel tank.

Figure 6:
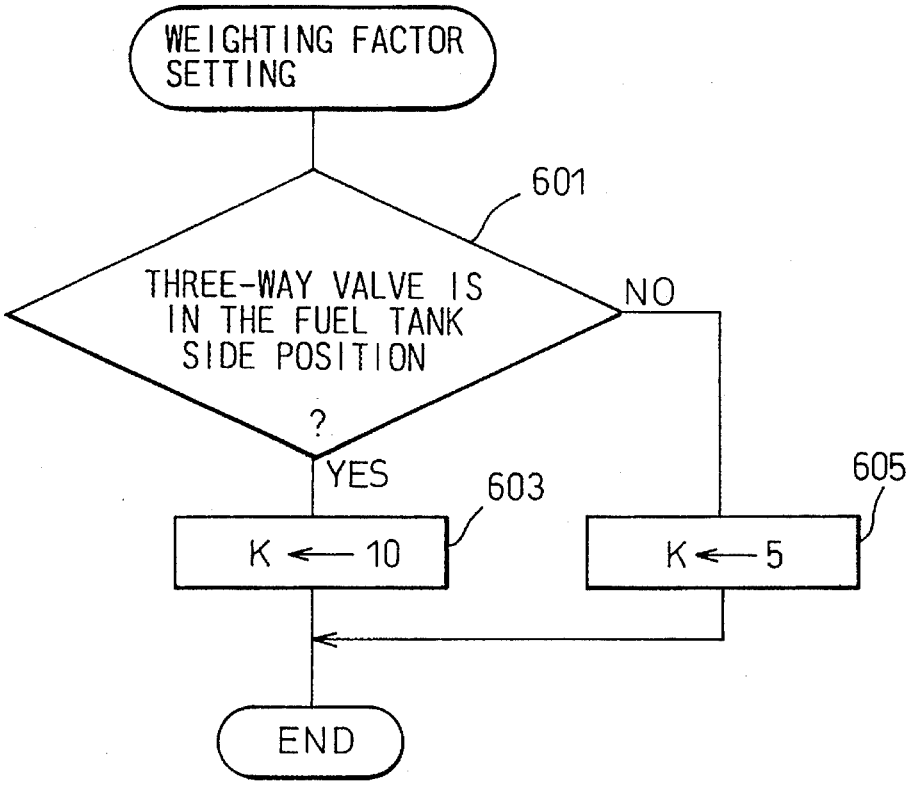
FIG. 6 is a flowchart illustrating an example of an operation for setting the degree of smoothing of the fluctuations of the pressure values.

FIG. 6 shows a flowchart illustrating the operation for setting the weighting factor K in the calculation of the smoothing pressure values shown in FIG. 5. This routine is performed by the control circuit 20 at predetermined intervals.

When the routine starts in FIG. 6, at step 601, it is determined whether the three-way switching valve 31 is in the position which connects the pressure sensor 30 to fuel vapor passage 12. If the three-way switching valve 31 is connected to the fuel vapor passage 12 at step 601, i.e., if the pressure sensor 30 is detecting the pressure in the fuel tank 11, the routine proceeds to step 603 which sets the weighting factor K at a relatively large value (for example, K=10). On the other hand, if the three-way switching valve 31 is in the position which connects the pressure sensor 30 to the purge gas passage 14 at step 601, i.e., if the pressure sensor 30 is detecting the pressure in the canister 10, the routine proceeds to step 605 which sets the weighting factor K at a relatively small value (for example, K=5). By executing this routine, the weighting factor K in the calculation of the smoothed pressure value $P_N$ of the fuel tank 11 is always set at a larger value than the same of the canister 10 when the routine in FIG. 5 is executed, thereby the error as explained above is eliminated from the detection of failure in the evaporative emission control system.

Next, another embodiment of the present invention is explained. As explained before, the amplitude of the pressure fluctuations of the fuel tank changes in accordance with the amount of fuel (fuel level) in the fuel tank. When the fuel level in the tank is high, since the volume in the tank above the fuel level is small, fluctuation of the pressure becomes large even if the movement of fuel in the tank is small. Further, when the fuel level is high, sometimes even larger fluctuations of the pressure are caused by the operation of a rollover valve which is provided in the fuel tank to prevent fuel from spilling from the tank when the automobile is overturned.

Figure 7:
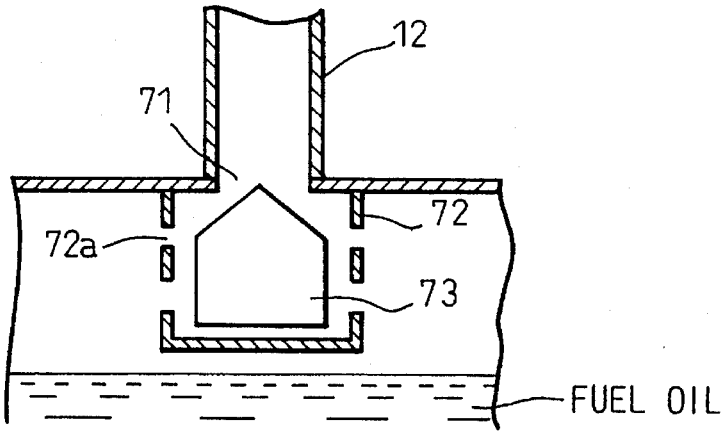
FIG. 7 is a drawing schematically illustrating a typical construction of a rollover valve in the fuel tank.

FIG. 7 schematically illustrates a typical configuration of the rollover valve in the fuel tank. In FIG. 7, reference numeral 71 denotes a port of the fuel tank II to which the fuel vapor passage 12 is connected, numeral 70 denotes a rollover valve disposed at the port 71. The rollover valve 70 consists of a cage 72 surrounding the port 71 and a float 73 disposed therein. A plurality of through holes **72*a* are provided on the side wall of the cage 72 to communicate the fuel vapor passage 12 to the fuel vapor volume formed in the fuel tank above the fuel level. In normal conditions, float 73 is pulled to the bottom of the cage 72 by gravity, thereby the port 71 is not blocked by the float 73. However, if the fuel in the tank reaches the port 71, for example, when the automobile is overturned, the float 73 is urged to the port 71 by fuel and blocks the port 71, thereby the spillage of the fuel from the port 71 is prevented. Though the rollover valve 70 is provided to block the port 71 in case of overturning of the automobile, the rollover valve sometimes blocks the port 71 due to the movement of the fuel when the fuel level in the tank is high. When the port 71 is blocked by the rollover valve 71, the pressure in the fuel vapor passage 12 largely changes, and the pressure detected by the pressure sensor 30 fluctuates largely in accordance with the movement of the float 73 (i.e., the movement of the fuel in the tank). Further, even when the port 71 is not blocked by the float 73, the holes 72*a* on the cage 72 are sometimes blocked by the splash of fuel when the fuel level in the tank is high. When the holes 72*a* are blocked, the pressure detected by the sensor 30** also largely fluctuates. These types of fluctuations occur more frequently when the fuel level in the tank is higher, i.e. as the amount of the fuel in the tank is larger.

Therefore, if the smoothed pressure value $P_N$ in the fuel tank when the amount of fuel in the tank is large is calculated using the weighting factor K suitable for a low fuel level condition in the tank, an error may occur due to insufficient smoothing of fluctuations. On the other hand, if the weighting factor K suitable for a high fuel level condition in the tank is used when the amount of fuel in the tank is small, an error may also occur since the response of the smoothed pressure value $P_N$ to the change in the pressure in the tank become too slow. Therefore, the value of the weighting factor K used in the calculation of the smoothed pressure value $P_N$ of the fuel tank is changed in accordance with the amount of fuel in the fuel tank in this embodiment, to thereby obtain a suitable smoothed pressure value in accordance with the fuel amount in the fuel tank.

Figure 8:
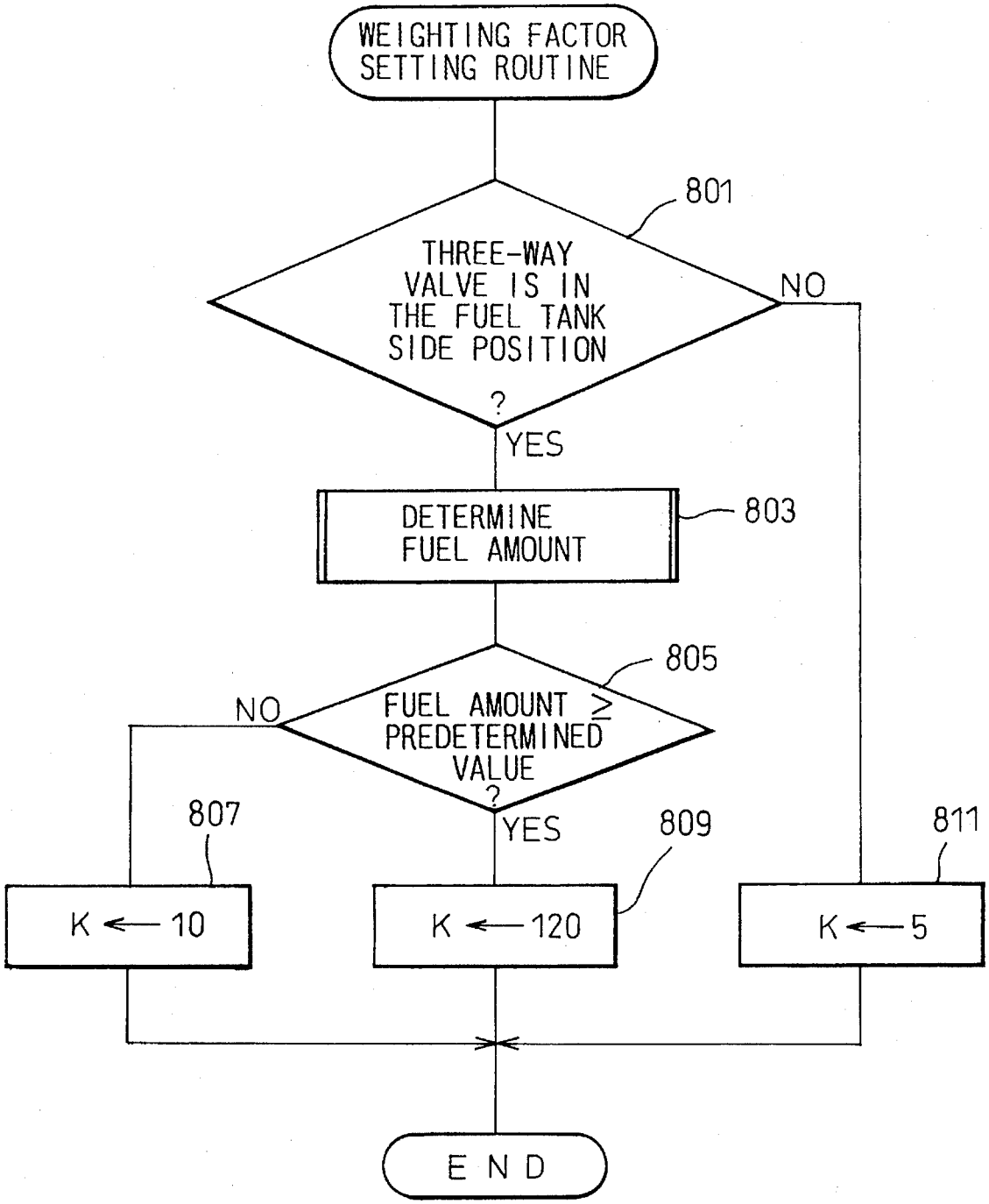
FIG. 8 is a flowchart illustrating another example of the operation for setting the degree of smoothing of the fluctuations of the pressure values.

FIG. 8 shows a flowchart illustrating the operation for setting the weighting factor K at a suitable value in accordance with the amount of fuel in the fuel tank. This routine is executed by the control circuit 20 at predetermined intervals.

In FIG. 8, at step 801, it is determined whether the pressure sensor 30 is detecting the pressure in the canister 10 or the pressure in the fuel tank 11 based on the position of the three-way switching valve 31. If the pressure sensor 30 is detecting the pressure in the canister 10, the routine proceeds to step 811 which sets the weighting factor K at a small value (for example, K=5). If the pressure sensor 30 is detecting the pressure in the fuel tank 11 at step 801, the control circuit 20 then determines the amount of fuel in the fuel tank at step 803.

At step 803, various methods can be used for determining the amount of fuel in the fuel tank. For example, the amount of the fuel may be detected by means of an acoustic type level sensor disposed on the top of the fuel tank. The acoustic type level sensor detects the fuel level by emitting an acoustic signal and receiving the signal reflected by the fuel surface. With a level sensor of this type, the fuel level, i.e., the amount of fuel in the fuel tank is directly detected. Further, the amount of the fuel in the tank may be determined indirectly by calculating the fuel consumption. For example, when fluctuation of the pressure in the fuel tank is very large, it is considered that the fuel tank is full. Once it is determined that the tank is full, the amount of the fuel in the tank at an arbitrary time point is obtained by subtracting the total amount of fuel consumed by the engine since the tank was last full, from the amount of the fuel when the tank is full. The total amount of consumed fuel may be obtained by calculating a cumulative value of the engine load (or, cumulating a value obtained by multiplying the engine load by the engine operating time). At step 803 in FIG. 8, the amount of fuel in the fuel tank is obtained using one or more of the methods explained above.

At step 805, it is determined whether the amount of fuel in the fuel tank 11 obtained at step 803 is larger than a predetermined value. If the amount of fuel is not larger than the predetermined value at step 805, since the magnitude of fluctuations of the pressure in the tank can be considered to be relatively small, the weighting factor K is set at a medium value (for example, K=10) at step 807. If the amount of fuel in the tank is larger than the predetermined value at step 805, since magnitude of fluctuations of the pressure in the tank is considered to be large, the weighting factor K is set at a large value (for example, K=120) at step 809. The predetermined value used at step 805 varies in accordance with the size and the configuration of the fuel tank 11. Therefore, it is preferable to determine this value by experiment using the actual fuel tank.

According to the embodiment in FIG. 8, since the weighting factor K used for calculating the smoothed pressure value $P_N$ of the fuel tank 11 is set larger as the amount of fuel in the tank becomes larger, a suitable smoothed pressure value $P_N$ can be obtained regardless of the amount of the fuel in the fuel tank.

Though the value of the weighting factor K is changed in accordance with whether the amount of fuel in the tank is larger than the predetermined value in the above embodiment, the value of the weighting factor K may be changed continuously according to the change in the amount of the fuel in the fuel tank. Further, though a single pressure sensor with a three-way switching valve is used to detect both the pressure in the canister and the pressure in the fuel tank in the above embodiments, the present invention can be applied to the case in which separate pressure sensors are used for detecting the pressures in the canister and the fuel tank.

In the calculation of the smoothed pressure value in FIG. 5, since the smoothed pressure value $P_{N(i-1)}$ when the routine last executed is used for obtaining the present smoothed pressure value $P_N$, the smoothed pressure value calculated immediately after the three-way switching valve 31 is switched is affected by the smoothed pressure value calculated before the switching of the valve 31. Therefore, it is preferable to start the failure detecting operation when a certain time has lapsed after the three-way switching valve 31 is switched. Alternatively, to avoid the influence of the smoothed pressure value before the valve 31 is switched, the value $P_{N(i-1)}$ may be replaced with a predetermined constant value (or, raw pressure value) when the routine in FIG. 5 is performed immediately after the switching of the valve 31.

As explained above, according to the present invention, failure in the evaporative emission control system can be detected precisely by using the smoothed pressure value which is obtained by smoothing the fluctuations of the pressures in the canister and the fuel tank according to the characteristics of the fluctuations.

I claim:

1. An evaporative emission control system for an internal combustion engine comprising:

a fuel tank containing fuel for an internal combustion engine;

a canister containing an adsorbent for adsorbing fuel vapor;

a fuel vapor passage which connects the canister to the fuel vapor volume above the fuel level inside the fuel tank;

a purging passage which, when the engine is operated at predetermined conditions, communicates the canister and an intake air passage of the engine to direct the fuel vapor released from the adsorbent to the intake air passage of the engine;

a pressure detecting device which detects the pressure in the canister and the pressure in the fuel tank separately;

smoothing means for obtaining smoothed pressure values of the canister and the fuel tank by smoothing fluctuations of the pressure values of the canister and the fuel tank detected by said pressure detecting device;

failure detecting means for detecting failure in the canister and the fuel tank separately based on the smoothed pressure value of the canister and the smoothed pressure value of the fuel tank, respectively; and wherein, said smoothing means obtains the smoothed pressure value of the fuel tank by smoothing fluctuations of the pressure values of the fuel tank at a higher degree of smoothing than the degree of smoothing of the fluctuations of the pressure values of the canister.

2. An evaporative emission control system according to claim 1, wherein said smoothing means obtains the smoothed pressure value by calculating a weighted mean between the last calculated smoothed pressure value and the pressure value detected by the pressure detecting device using a predetermined weighting factor, and wherein the weighting factor used in the calculation of the smoothed pressure value of the fuel tank is larger than the weighting factor used in the calculation of the smoothed pressure value of the canister.

3. An evaporative emission control system for an internal combustion engine comprising:

a fuel tank containing fuel for an internal combustion engine;

a canister containing an adsorbent for adsorbing fuel vapor;

a fuel vapor passage which connects the canister to fuel vapor volume above the fuel level inside the fuel tank;

a purging passage which, when the engine is operated at predetermined conditions, communicates the canister and an intake air passage of the engine to direct the fuel vapor released from the adsorbent to the intake air passage of the engine;

a pressure detecting device which detects the pressure in the canister and the pressure in the fuel tank separately;

smoothing means for obtaining smoothed pressure values of the canister and the fuel tank by smoothing fluctuations of the pressure values of the canister and the fuel tank detected by said pressure detecting device;

failure detecting means for detecting failure in the canister and the fuel tank separately based on the smoothed pressure value of the canister and the smoothed pressure value of the fuel tank, respectively; and wherein, said smoothing means obtains the smoothed pressure value of the fuel tank by smoothing fluctuations of the pressure values of the fuel tank in such a manner that a degree of smoothing of the fluctuations of the pressure values is higher as the amount of fuel in the fuel tank is larger.

4. An evaporative emission control system according to claim 3, wherein said smoothing means obtains the smoothed pressure value by calculating a weighted mean between the last calculated smoothed pressure value and the pressure value detected by the pressure detecting device using a predetermined weighting factor, and wherein the weighting factor used in the calculation of the smoothed pressure value of the fuel tank is set larger as the amount of fuel in the fuel tank is larger.

* * * * *